US010710618B2

(12) United States Patent
Bohme et al.

(10) Patent No.: US 10,710,618 B2
(45) Date of Patent: Jul. 14, 2020

(54) MOUNTING ARRANGEMENT FOR RAILWAY WAYSIDE SIGNAL APPLICATIONS

(71) Applicant: Siemens Industry, Inc., Alpharetta, GA (US)

(72) Inventors: Richard C. Bohme, Louisville, KY (US); Carrie Williamson, Eddyville, KY (US); Nicholas Torris, Crestwood, KY (US)

(73) Assignee: SIEMENS MOBILITY, INC., New York, NY (US)

( * ) Notice: Subject to any disclaimer, the term of this patent is extended or adjusted under 35 U.S.C. 154(b) by 279 days.

(21) Appl. No.: 15/751,744

(22) PCT Filed: Jul. 8, 2016

(86) PCT No.: PCT/US2016/041490

§ 371 (c)(1),
(2) Date: Feb. 9, 2018

(87) PCT Pub. No.: WO2017/044183

PCT Pub. Date: Mar. 16, 2017

(65) Prior Publication Data

US 2018/0244291 A1 Aug. 30, 2018

Related U.S. Application Data

(60) Provisional application No. 62/216,428, filed on Sep. 10, 2015.

(51) Int. Cl.
*B61L 5/18* (2006.01)

(52) U.S. Cl.
CPC ..... *B61L 5/1863* (2013.01)

(58) Field of Classification Search
CPC ..... B61L 5/1863
See application file for complete search history.

(56) References Cited

U.S. PATENT DOCUMENTS 1,397,843 A * 11/1921 Rapp ..... B61L 5/1863 248/230.5
1,666,102 A * 4/1928 McCarthy ..... B61L 5/1863 248/278.1

(Continued)

FOREIGN PATENT DOCUMENTS

DE 487045 C 11/1929
DE 8423129 U1 8/1984

(Continued)

OTHER PUBLICATIONS

PCT International Search Report and Written Opinion of International Searching Authority dated Sep. 30, 2016 corresponding to PCT International Application No. PCT/US2016/041490 filed Jul. 8, 2016.

*Primary Examiner* — Zachary L Kuhfuss

(57) ABSTRACT

A mounting arrangement (100) includes an attachment member (102) for attachment to an end of a post (114), a connecting member (104) coupled to the attachment member (102), and a plurality of fastening elements (110) coupling the connecting member (104) to the attachment member (102), each fastening element (110) comprising a longitudinal axis (110A), longitudinal axes (110A) of the plurality of fastening elements (110) being substantially parallel to each other. The connecting member (104) is coupled to the attachment member (102) in a direction defined by the longitudinal axes (110A) of the plurality of fastening elements (110), wherein the attachment member (102) and the connecting member (104) comprise mating cylindrical surfaces (118, 140) which allow a tilting motion of the connecting member (104) about a rotating axis which (Continued)

is perpendicular to the longitudinal axes (110A) of the plurality of fastening elements (110).

18 Claims, 7 Drawing Sheets

(56) References Cited

U.S. PATENT DOCUMENTS

| | | | | | |
|---|---|---|---|---|---|
| 1,682,693 | A * | 8/1928 | Day | B61L 5/1863 | 248/274.1 |
| 1,748,913 | A * | 2/1930 | Day | B61L 5/1809 | 246/473.3 |
| 1,794,617 | A * | 3/1931 | Howe | B61L 5/1863 | 248/278.1 |
| 1,936,260 | A * | 11/1933 | Peabody | B61L 5/1836 | 246/473.3 |
| 1,969,089 | A * | 8/1934 | Merkel | B61L 5/1854 | 246/473.3 |
| 1,985,951 | A * | 1/1935 | Richterkessing | B61L 5/1863 | 248/218.4 |
| 2,145,788 | A * | 1/1939 | Field | B61L 5/1863 | 248/230.9 |
| 5,433,166 | A * | 7/1995 | Donatello | B61L 5/1836 | 116/202 |
| 9,132,844 | B2 * | 9/2015 | Wood | B61L 5/1863 | |
| 2013/0008094 | A1 | 1/2013 | Wood et al. | | |
| 2018/0244291 | A1 * | 8/2018 | Bohme | B61L 5/1863 | |

FOREIGN PATENT DOCUMENTS

| | | | |
|---|---|---|---|
| EP | 2154474 | A2 | 2/2010 |
| GB | 212905 | A | 9/1924 |

* cited by examiner

MOUNTING ARRANGEMENT FOR RAILWAY WAYSIDE SIGNAL APPLICATIONS

CROSS REFERENCE TO RELATED APPLICATIONS

This application is the U.S. National Stage of International Application No. PCT/US2016/041490 filed 8 Jul. 2016 and claims benefit thereof, the entire content of which is hereby incorporated herein by reference. The International Application No. PCT/US2016/041490 claims priority to U.S. Provisional Application No. 62/216,428 filed 10 Sep. 2015, the entire content of which is hereby incorporated herein by reference.

BACKGROUND

1. Field

Aspects of the present invention generally relate to a mounting arrangement for mounting a utility, such as a signalling unit, to an end of a post or mast. Specifically, the mounting arrangement is for use in a railway setting, for mounting railway signal units to posts which are positioned to the side of railway tracks and which provide signals to train operators. It will be appreciated that the present invention will have wider applicability and, for example, will be applicable to many forms of post mounted lighting, signalling or other utility.

2. Description of the Related Art

The railroad industry, including but not limited to the freight railroad industry, employs wayside signals including for example signal lights to inform train operators of various types of operational parameters. For example, colored wayside signal lights are often used to inform a train operator as to whether and how a train may enter a block of track associated with the wayside signal light. The status/color of wayside signal lights, i.e. lamps, is sometimes referred to in the art as the signal aspect. One simple example is a three color system known in the industry as Automatic Block Signaling (ABS), in which a red signal indicates that the block associated with the signal is occupied, a yellow signal indicates that the block associated with the signal is not occupied but the next block is occupied, and green indicates that both the block associated with the signal and the next block are unoccupied. It should be understood, however, that there are many different kinds of signaling systems. Other uses of signal lights to provide wayside status information include lights that indicate switch position, hazard detector status (e.g., broken rail detector, avalanche detector, bridge misalignment, grade crossing warning, etc.), search light mechanism position, among others.

Wayside signals are typically mounted on a post, herein also referred to as mast, which include for example a signal head comprising the signal lights at some height above the track so that the signal lights can be seen at a distance. The post or mast is designed such that the signal head can be mounted to the top of the post or mast.

Existing top mast designs include for example an assembly intended to mount a utility, such as a railway signal head, to a first member of the assembly, while a second member is arranged to be attached to the upper end of a supporting post. A connection between the first member and the second member of the assembly has to be strong as well as allow adjustment of the railway signal head. Because signals are often required to be visible to a train operator over a significant distance, orientation or direction of the signal head requires a high degree of accuracy. Typically, the alignment accuracy must be within ±2.5°. But current top mast designs can be susceptible to high wind failures (high winds include winds with wind speeds of 90 mph or more), serviceability issues, shipping damage, which can further result in rail disruptions from signal outages, for example excessive train delays. Thus, there exists a need for an improved mounting arrangement for mounting a railway signal head to a post or mast.

SUMMARY

Briefly described, aspects of the present invention relate to a mounting arrangement for mounting a utility, such as a signalling unit, to an end of a post or mast, and a railway wayside signal assembly comprising such a mounting arrangement. Specifically, the mounting arrangement is for mounting railway signal units to posts which are positioned to the side of railway tracks and which provide signals to train operators.

A first aspect of the present invention provides a mounting arrangement comprising an attachment member for attachment to an end of a post, a connecting member coupled to the attachment member, and a plurality of fastening elements coupling the connecting member to the attachment member, each fastening element comprising a longitudinal axis, longitudinal axes of the plurality of fastening elements being substantially parallel to each other, wherein the connecting member is coupled to the attachment member in a direction defined by the longitudinal axes of the plurality of fastening elements, and wherein the attachment member and the connecting member comprise mating cylindrical surfaces which allow a tilting motion of the connecting member about a rotating axis which is perpendicular to the longitudinal axes of the plurality of fastening elements.

A second aspect of the present invention provides a railway wayside signal assembly comprising a post or mast for installing along a railway track, a mounting arrangement carried by the post or mast, the mounting arrangement comprising an attachment member for attachment to an end of the post or mast, a connecting member coupled to the attachment member, and a plurality of fastening elements coupling the connecting member to the attachment member, each fastening element comprising a longitudinal axis, longitudinal axes of the plurality of fastening elements being substantially parallel to each other, wherein the connecting member is coupled to the attachment member in a direction defined by the longitudinal axes of the plurality of fastening elements, and wherein the attachment member and the connecting member comprise mating cylindrical surfaces which allow a tilting motion of the connecting member about a rotating axis which is perpendicular to the longitudinal axes of the plurality of fastening elements.

DETAILED DESCRIPTION

To facilitate an understanding of embodiments, principles, and features of the present invention, they are explained hereinafter with reference to implementation in illustrative embodiments. In particular, they are described in the context of a mounting arrangement, and a railway wayside signal assembly comprising a post or mast for installing along a railway track carrying such a mounting arrangement for railway wayside signal applications. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
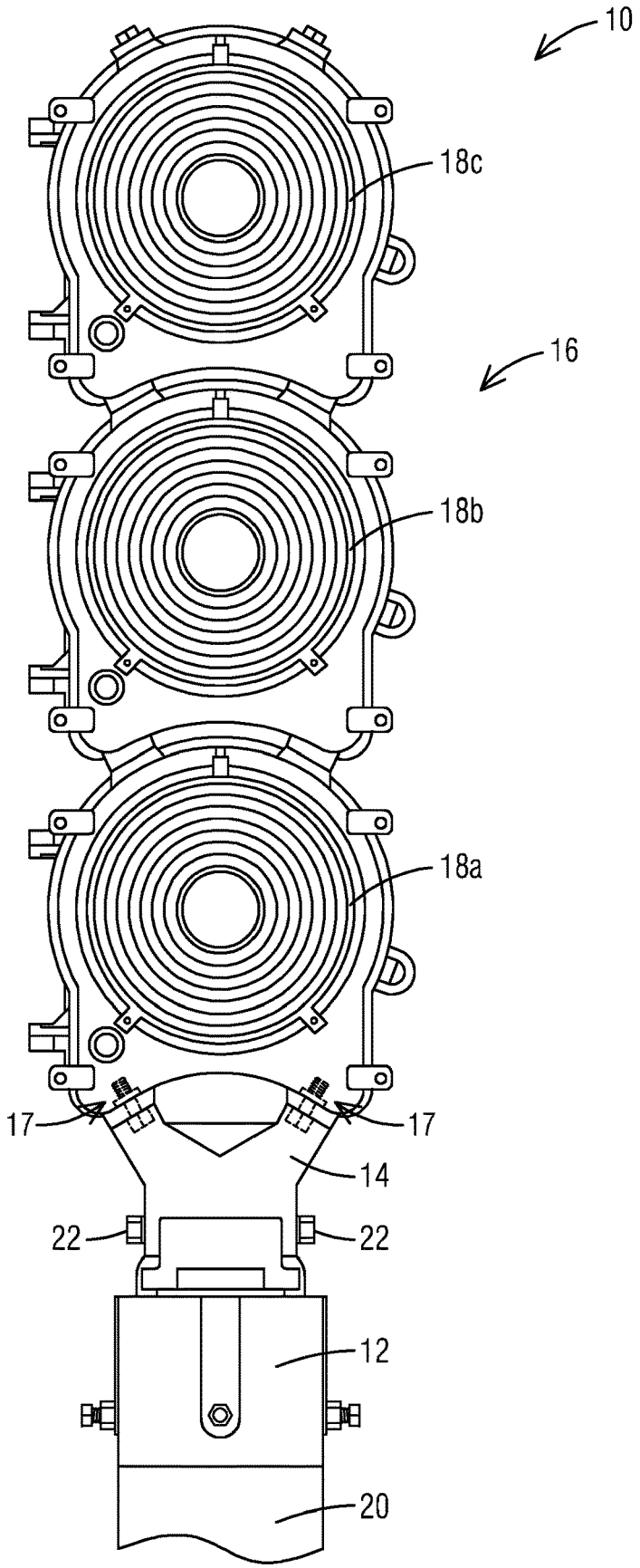
FIG. 1 PRIOR ART
FIG. 1 illustrates a front view of a known mounting arrangement including a signal head.

FIG. 1 illustrates a front view of a known arrangement 10 for railway wayside signal applications. The arrangement 10 includes a first member 12 and a second member 14 coupled to each other. The first member 12 is arranged to be attached to an upper end of a supporting post 20, and the second member 14 is for mounting a railway signal head 16 to an upper surface of the second member 14. The signal head 16 comprises a plurality of signal lights 18*a*, 18*b*, 18*c*. FIG. 1 shows an example of a three color system comprising for example a red signal 18*a*, a yellow signal 18*b*, and a green signal 18*c*. The signals 18*a*, 18*b* and 18*c* can comprise LED and/or incandescent lighting. But known arrangements, such as the arrangement 10, may be susceptible to breakage during shipping or failures when installed, for example because connections 22 between the first member 12 and second member 14 may not be as strong and secure as required. Furthermore, the signal head 16 is connected to the upper surface of the second member 14 by multiple bolts and lock nuts, shown schematically as bolt-nut-connections 17. As FIG. 1 shows, the bolt-nut-connections 17 are not easily accessible, because the heads of the bolts are positioned inside the second member 14 and the lock nuts are positioned inside the signal head 16. But the bolt-nut-connections 17 may loosen during shipping or installing or simply over time once installed in the field, and therefore may need to be accessed and retightened. In order to be able to access and retighten the connections 17, the first member 12 and second member 14 have to be disassembled via the connections 22. Disassembling of the first and second members 12 and 14 complicates maintenance and service of the signal arrangement 10.

Figure 2:
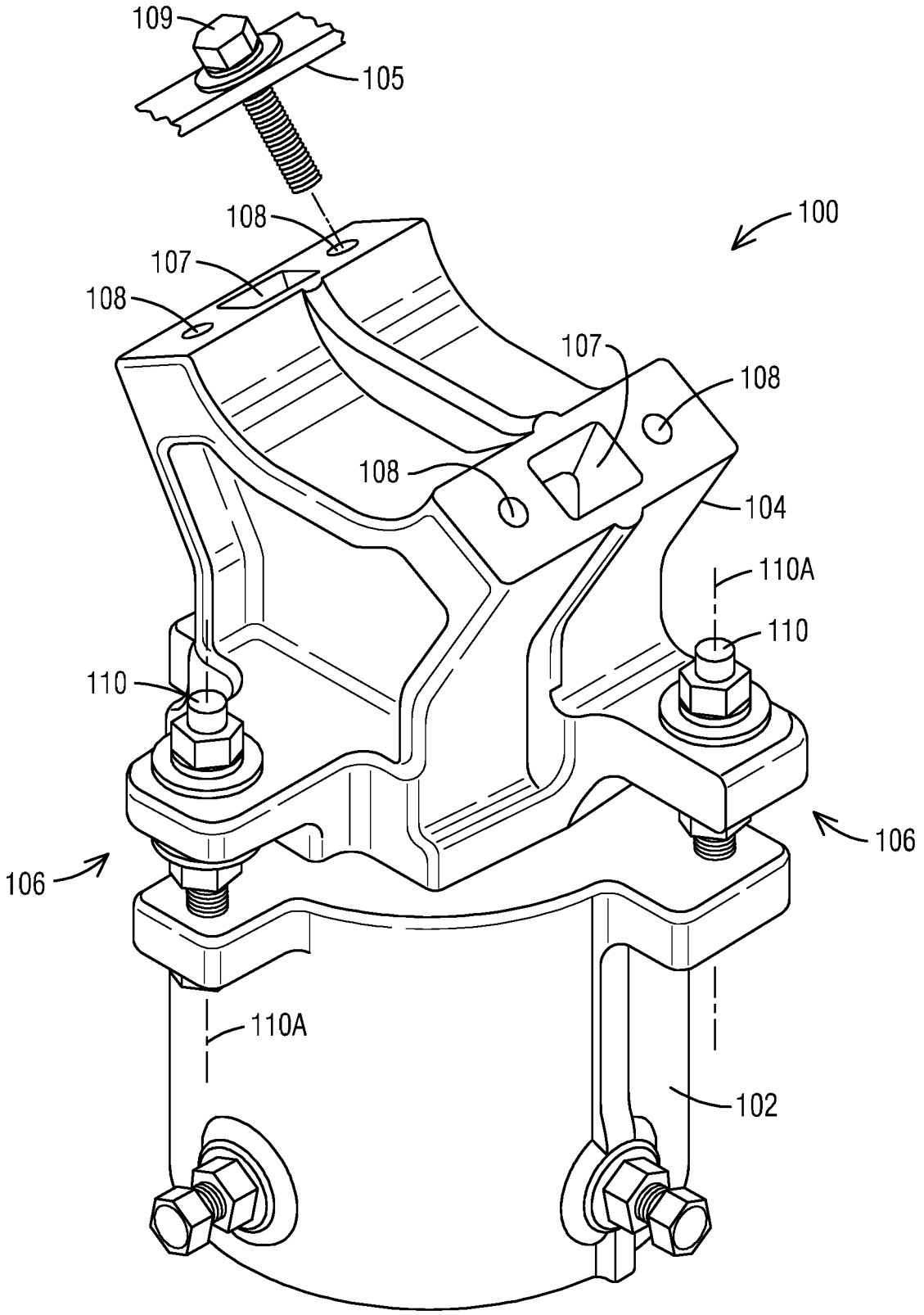
FIG. 2 illustrates a perspective view of a mounting arrangement in accordance with an exemplary embodiment of the present invention.

FIG. 2 illustrates a perspective view of a mounting arrangement 100 in accordance with an exemplary embodiment of the present invention. The mounting arrangement 100 comprises an attachment member 102 and a connecting member 104. The attachment member 102 is arranged to be attached to an upper end of a supporting post, and the connecting member 104 is for mounting a railway signal head to an upper surface of the connecting member 104. The attachment member 102 and the connecting member 104 are assembled in such a way that a strong and secure connection as well as adjustment of the connecting member 104 and thus a signal head attached to the connecting member 104 are provided.

The attachment member 102 and the connecting member 104 are connected to each other by a plurality of connections or joints 106. Each connection or joint 106 comprises a fastening element 110 which is configured as an adjusting stud. Each fastening element 110 comprises a longitudinal axis 110A, longitudinal axes 110A of the plurality of fastening elements 110 being substantially parallel to each other. The longitudinal axes 110A of the fastening elements 100 define a direction for coupling the attachment member 102 and the connecting member 104.

With further reference to FIG. 2, the connecting member 104 comprises openings 108 used for connecting a signal head to the connecting member 104. For example, the openings 108 can be tapped mounting holes, wherein the signal head is fastened by bolts to the connecting member 104. In an exemplary embodiment, the connecting member 104 comprises four tapped mounting holes 108, wherein each tapped mounting hole 108 receives a bolt. FIG. 2 illustrates an example of a bolt 109 and how the bolt 109 would be positioned in relation to the connecting member 104. In contrast to known arrangements 10 as for example illustrated in FIG. 1, bolt heads of bolts 109 are now positioned within a signal head housing (schematically indicated by section 105), instead of the connecting member 104, and can thus be easily accessed from the signal head housing. Additional lock nuts are not necessary because the mounting holes 108 are embodied as tapped or threaded mounting holes 108. Attachment member 102 and connecting member 104 do not need to be disassembled in order to be able to access the bolts 109 in case they need to be retighten once the signal unit is installed in the field which provides easier maintenance and service of the signal unit.

Furthermore, the connecting member 104 comprises wire openings 107 which are used for arranging electric connections such as for example power cables and control signal wires for the signal head (see also FIG. 8) needed for operation of the signal head.

The fastening elements 110 provide strong and secure connections between the attachment member 102 and the connecting member 104, and function as structural supports in all wind loaded directions when the mounting arrangement 100 together with a signal head are installed along a railway track.

In an exemplary embodiment, the fastening elements 110 comprise metal and/or metal alloy. For example, the fastening elements 110 comprise aluminum, in particular consist entirely of aluminum. In a further embodiment, the fastening elements 110 comprise aluminum which has T6 heat treatment to increase strength. T6 heat treatment is applied to aluminum castings to increase for example hardness and other mechanical properties. It should be noted that one of ordinary skill in the art is familiar with T6 heat treatment.

Furthermore, the mounting arrangement 100 allows adjusting of the connecting member 104, and thus an attached signal head, because signal heads need to be able to be aligned in order to be properly visible to a train operator over a significant distance. Thus, the connections 106 are designed such that they allow for at least a ±2.5° tilting motion, i. e. a total tilting motion over at least about 5°, of the connecting member 104 to align the signal head once installed in the field. The mounting arrangement 100 can be designed such that it allows a total tilting motion greater than 5°. Further details of the mounting arrangement 100 will be described with reference to the following figures.

Figure 3:
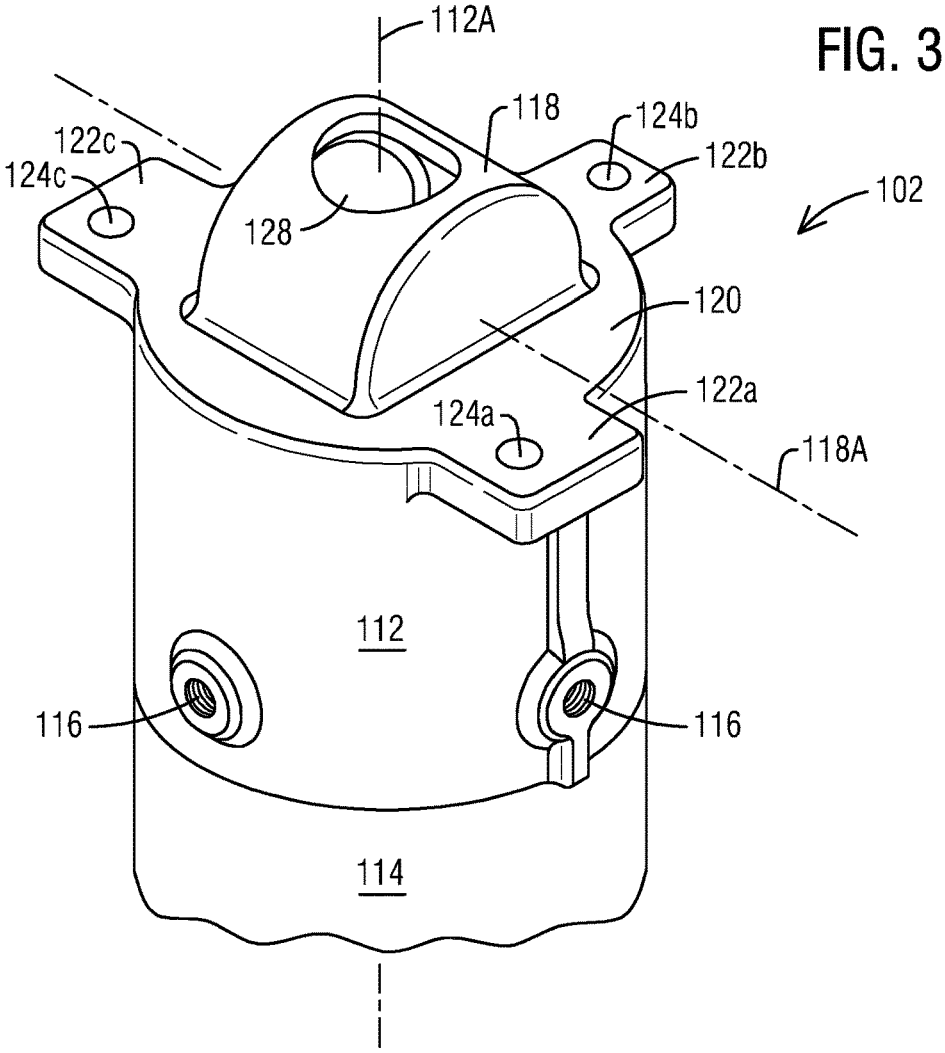
FIG. 3 illustrates a perspective view of an attachment member of a mounting arrangement in accordance with an exemplary embodiment of the present invention.
Figure 4:
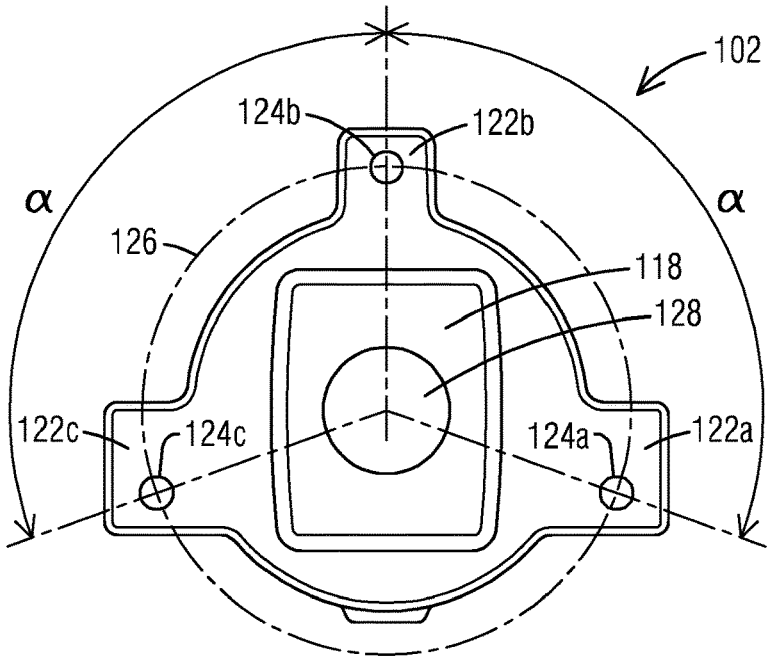
FIG. 4 illustrates a top view of the attachment member of FIG. 3 in accordance with an exemplary embodiment of the present invention.

FIG. 3 illustrates a perspective view of an attachment member 102, and FIG. 4 illustrates a top view of the attachment member 102 of FIG. 3, in accordance with an exemplary embodiment of the present invention.

The attachment member 102 comprises a cylindrical base body 112 so that the attachment member 102 can be fixed to an end of a cylindrical post 114. The attachment member 102 can be fixed to the post 114 in many suitable manners, for example via a plurality of set screws or bolts 160 as illustrated for example in FIG. 8 and FIG. 9. Thus, the base body 112 comprises a plurality of openings 116, for example threaded openings, for receiving the set screws 160. Specifically, the base body 112 comprises four evenly distributed threaded openings 116 located at a lower end of the base body 112, wherein each opening 116 is provided for receiving a set screw 160. The base body 112 can comprise more or less openings 116 according to different requirements. Other forms of attachment of the attachment member 102 to the post end 114 can include for example grub screws or friction fits.

The attachment member 102 further comprises a convex surface. In an exemplary embodiment, the convex surface is configured as a half cylinder or half round, and herein referred to as cylindrical surface 118. The cylindrical surface 118 is arranged on an upper end of the base body 112 opposite the openings 116, and forms part of an upper surface 120 of the attachment member 102. The convex cylindrical surface 118 is curved toward the connecting member 104 (see for example FIG. 8). The cylindrical surface 118 is arranged such that a cylinder axis (or central axis) 118A of the mathematical half cylinder providing the surface 118 is perpendicular to a cylinder axis (or central axis) 112A of the cylindrical base body 112. The cylindrical surface 118 comprises a circular opening 128 used for arranging signal head hardware such as for example cables etc.

With reference to FIGS. 3 and 4, the attachment member 102 comprises a plurality of extensions 122*a*, 122*b*, 122*c* on an upper end of the base body 112 used for providing the connections 106 (see FIG. 2). The extensions 122*a*, 122*b*, 122*c* extend outwards from the base body 112 and upper sides of the extensions 122*a*, 122*b*, 122*c* form parts of the upper surface 120 of the attachment member 102. As FIG. 4 illustrates, the extension 122*b* is arranged at a right angle to the extensions 122*a* and 122*c*, and the extensions 122*a* and 122*c* lie opposite each other.

Each extension 122*a*, 122*b*, 122*c* comprises a circular opening 124*a*, 124*b*, 124*c* which each receive a fastening element 110 as introduced in FIG. 2 for coupling the connecting member 104 to the attachment member 102. The openings 124*a*, 124*b*, 124*c* are each configured as tapped holes. The opening 124*b* of extension 122*b* is arranged substantially centric within the extension 122*b*. The openings 124*a* and 124*c* are arranged eccentric, i.e. off-center, within the extensions 122*a* and 122*c*. All the openings 124*a*, 124*b*, 124*c* are arranged such that center points of the circular openings 124*a*, 124*b*, and 124*c* lie on a mathematical circle 126. Angles α between center points of openings 124*a* and 124*b* as well as openings 124*b* and 124*c* is for example 110°. But the extensions 122*a*, 122*b*, 122*c* and/or the openings 124*a*, 124*b*, 124*c* can be arranged at different angles to each other.

The attachment member 102 is configured such that it is mountable to the end of the post 114 which is cylindrical. But the present mounting arrangement 100, specifically the attachment member 102, can be modified such that it is also applicable to post ends having a different shape, such as square, rectangular or hexagonal cross-section, or beams having a web and flange cross-section such as an I-beam or a C-beam.

Figure 5:
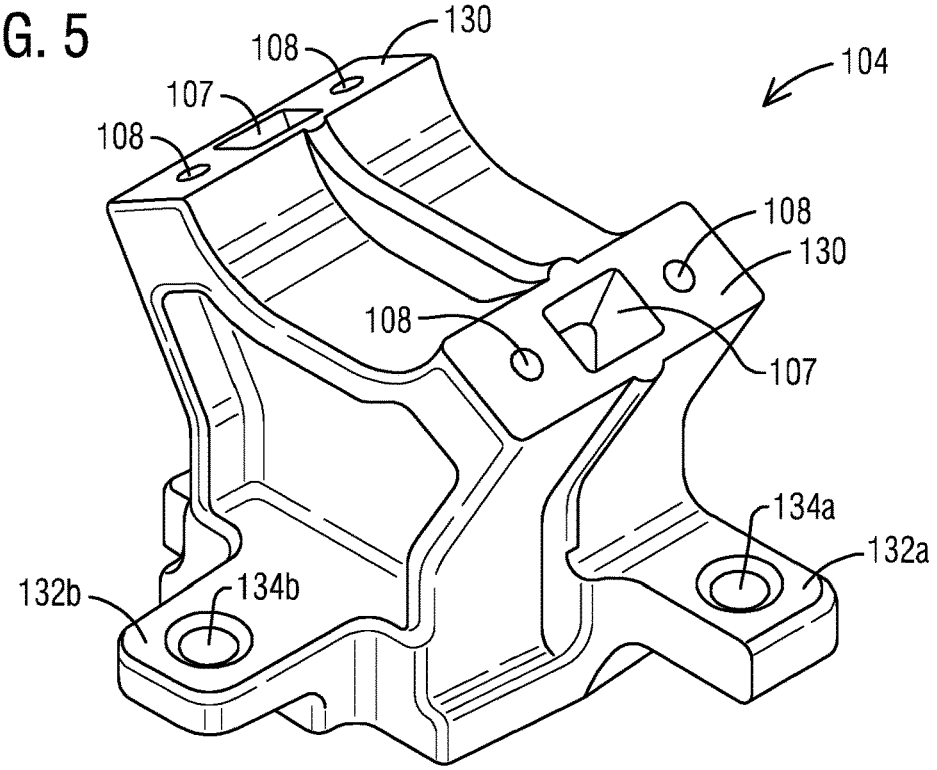
FIG. 5 illustrates a perspective view of a connecting member of a mounting arrangement in accordance with an exemplary embodiment of the present invention.
Figure 6:
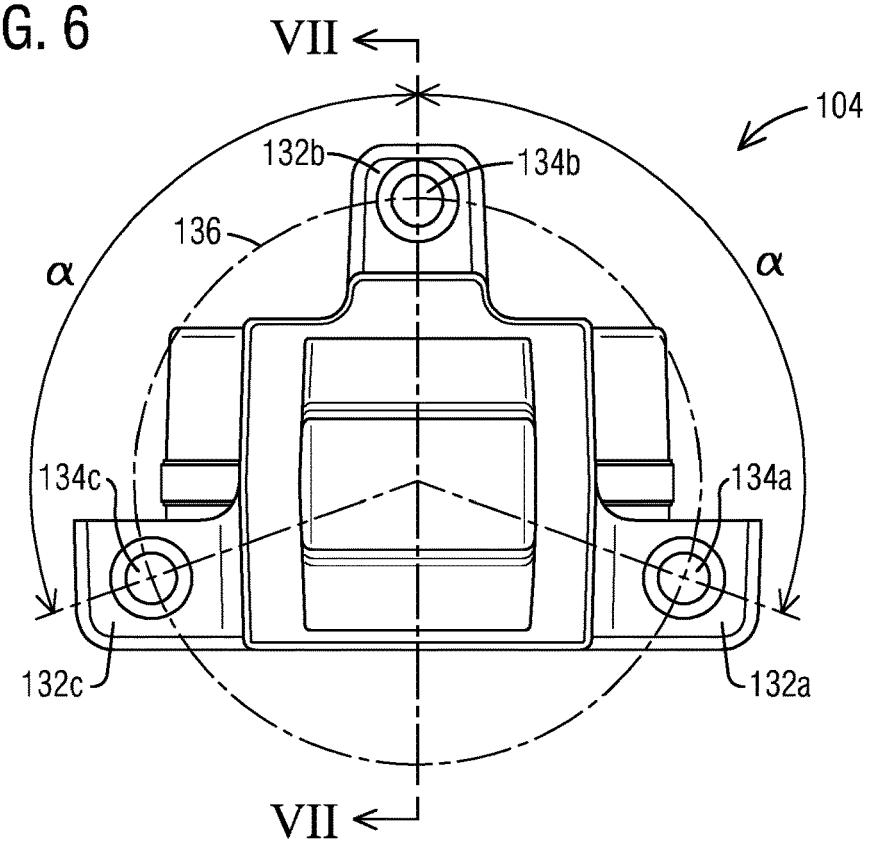
FIG. 6 illustrates a top view of the connecting member of FIG. 5 in accordance with an exemplary embodiment of the present invention.

FIG. 5 illustrates a perspective view of a connecting member 104 of a mounting arrangement 100, and FIG. 6 illustrates a top view of the connecting member 104 of FIG. 5, in accordance with an exemplary embodiment of the present invention.

As described before, the connecting member 104 is for mounting a railway signal head to upper surfaces 130 of the connecting member 104. As described before in connection with FIG. 2, the connecting member 104, specifically the upper surfaces 130, each comprise a wire opening 107 and tapped mounting holes 108 used for connecting a signal head to the connecting member 104, and for providing electric connections to the signal head.

The connecting member 104 is a casted component comprising a plurality of extensions 132*a*, 132*b*, 132*c* in a lower portion of the connecting member 104 which are used for providing the connections 106 (see FIG. 2). The extensions 132*a*, 132*b*, 132*c* extend outwards from the connecting member 104. Each extension 132*a*, 132*b*, 132*c* comprises a circular opening 134*a*, 134*b*, 134*c* which each receive a fastening element 110 (see FIG. 2). The openings 134*a*, 134*b*, 134*c* are each configured as tapped holes. As FIGS. 4 and 6 show, the extensions 132*a*, 132*b*, 132*c* correspond to the extensions 122*a*, 122*b*, 122*c* of the attachment member 102 so that the fastening elements 110 can couple the connecting member 104 and the attachment member 102 via the extensions 122*a*, 122*b*, 122*c*, 132*a*, 132*b*, 132*c*. Specifically, extension 132*a* faces extension 122*a*, extension 132*b* faces extension 122*b*, and extension 132*c* faces extension 122*c* (see also FIG. 9).

With further reference to FIG. 6, the extension 132*b* is arranged at a right angle to the extensions 132*a* and 132*c*, and the extensions 132*a* and 132*c* lie opposite each other. The openings 134*a*, 134*b*, 134*c* are arranged substantially centric within the extensions 132*a*, 132*b*, 132*c*. All the openings 134*a*, 134*b*, 134*c* are arranged such that center points of the circular openings 134*a*, 134*b*, 134*c* lie on a mathematical circle 136. Angles α between center points of openings 134*a* and 134*b* as well as openings 134*b* and 134*c* can be 110°. The extensions 132*a*, 132*b*, 132*c* and/or the openings 134*a*, 134*b*, 134*c* can be arranged at different angles to each other. But when arranged at different angles, the extensions 132*a*, 132*b*, 132*c* and openings 134*a*, 134*b*, 134*c* must then be aligned with corresponding extensions 122*a*, 122*b*, 122*c* and openings 124*a*, 124*b*, 124*c* of the attachment member 102 in order to be able to insert the fastening elements 110.

Figure 7:
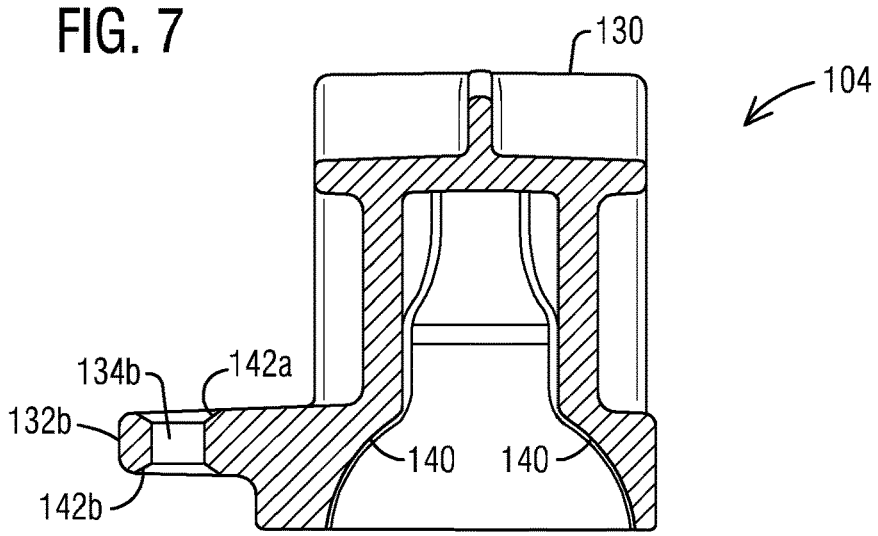
FIG. 7 illustrates a sectional view of a longitudinal cut through the connecting member as indicated in FIG. 6 in accordance with an exemplary embodiment of the present invention.

FIG. 7 illustrates a sectional view of a longitudinal cut through the connecting member 104 as indicated in FIG. 6 in accordance with an exemplary embodiment of the present invention.

FIG. 7 shows that the connecting member 104 further comprises a concave surface, herein referred to as cylindrical surface 140. The cylindrical surface 140 is arranged opposite the surfaces 130 used for mounting a signal head to the connecting member 104. The cylindrical surface 140 is curved toward an inside of the connecting member 104. FIG. 7 further shows one of the extensions, in particular extension 132*b* with circular opening 134*b*.

Figure 8:
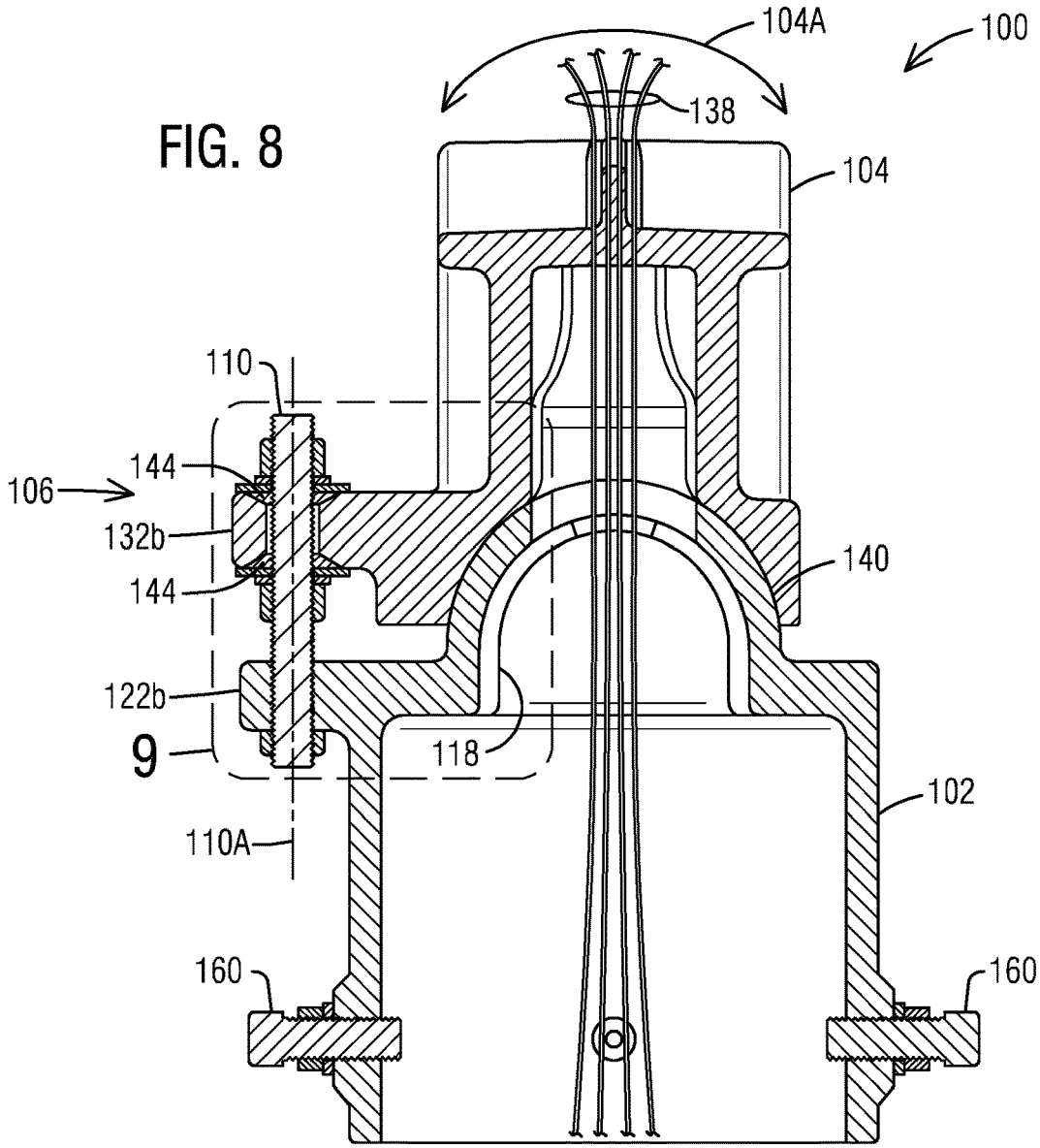
FIG. 8 illustrates a sectional view of a longitudinal cut through the mounting arrangement in accordance with an exemplary embodiment of the present invention.

FIG. 8 illustrates a sectional view of a longitudinal cut through the mounting arrangement 100 in accordance with an exemplary embodiment of the present invention. Specifically, the view of connecting member 104 in FIG. 8 corresponds to the view as illustrated in FIG. 7, wherein the sectional view is extended to the attachment member 102.

With reference to FIGS. 7 and 8, the arrangement 100 is designed such that the connecting member 104 can be tilted relative to the attachment member 102. This is achieved by the convex cylindrical surface 118 of the attachment member 102 and the concave cylindrical surface 140 of the connecting member. The cylindrical surfaces 118 and 140 are mating cylindrical surfaces, which allow the tilting motion of the connecting member 104 relative to the attachment member 102 as indicated by arrow 104A. In particular, the mating surfaces 118 and 140 allow a tilting motion (see arrow 104A) of at least ±2.5° to align a signal head carried by the connecting member 104 (see also FIG. 9).

FIG. 8 further illustrates electric connections 138, for example wires and cables, which run through the attachment member 102, specifically the through hole 128 (see FIG. 3), and the connecting member 104, specifically the wire openings 108, to the signal head (not illustrated). The present configuration of the attachment member 102 allows easy access to the electric connections 138.

Each fastening element 110 comprises a longitudinal axis 110A, longitudinal axes 110A of the plurality of fastening elements 110 being substantially parallel to each other. As illustrated in FIGS. 2 and 8, the connecting member 104 is coupled to the attachment member 102 in a direction defined by the longitudinal axes 110A of the plurality of fastening elements 110. The tilting motion of the connecting member 104 relative to the attachment member 102, indicated by the arrow 104A, is about a rotating axis which is perpendicular to the longitudinal axes 110A of the plurality of fastening elements 110. The rotating axis corresponds to the cylinder axis 118A of the cylindrical surface 118 (see FIG. 3). The connecting member 104 is rotatable about the rotating axis over an angle of at least about 5°.

To support the tilting motion 104A of the connecting member 104, a design of the connections 106 is adapted accordingly. In an exemplary embodiment, the circular openings 134*a*, 134*b*, 134*c* of the connecting member 104 are designed such that they each comprise concave spherical radiuses at both ends of the openings 134*a*, 134*b*, 134*c*. For example, FIG. 7 illustrates that the opening 134*b* comprises a concave spherical radius 142*a* at one axial end of the opening and a further concave radius 142*b* at an opposite axial end. In addition, spherical washers 144 with a convex spherical radius are provided (see FIGS. 8 and 9).

With reference to FIG. 8, spherical washers 144 are placed such that they abut upon the concave spherical radiuses 142*a*, 142*b* of the opening 134*b*. The spherical washers 144 comprise a convex surface. The spherical washers 144 together with the openings 134*a*, 134*b*, 134*c* comprising spherical radiuses provide a secure connection, specifically when the connecting member 104 is tilted relative to the attachment member 102 (see FIG. 9). In such a case, the extensions 122*a*, 122*b*, 122*c* of the attachment member 102 and the extensions 132*a*, 132*b*, 132*c* of the connecting member 104 are non-parallel and thus need special features to provide a strong and secure connection. The spherical washers 144 together with the specific openings 134*a*, 134*b*, 134*c* of the connecting member 104 and the fastening elements 110 provide such a strong and secure connection. The connections between the fastening elements 110 and the extensions 122*a*, 122*b*, 122*c* of the attachment member 102 are rigid connections since a position of the attachment member 102 does not change when tilting the connecting member 104.

Figure 9:
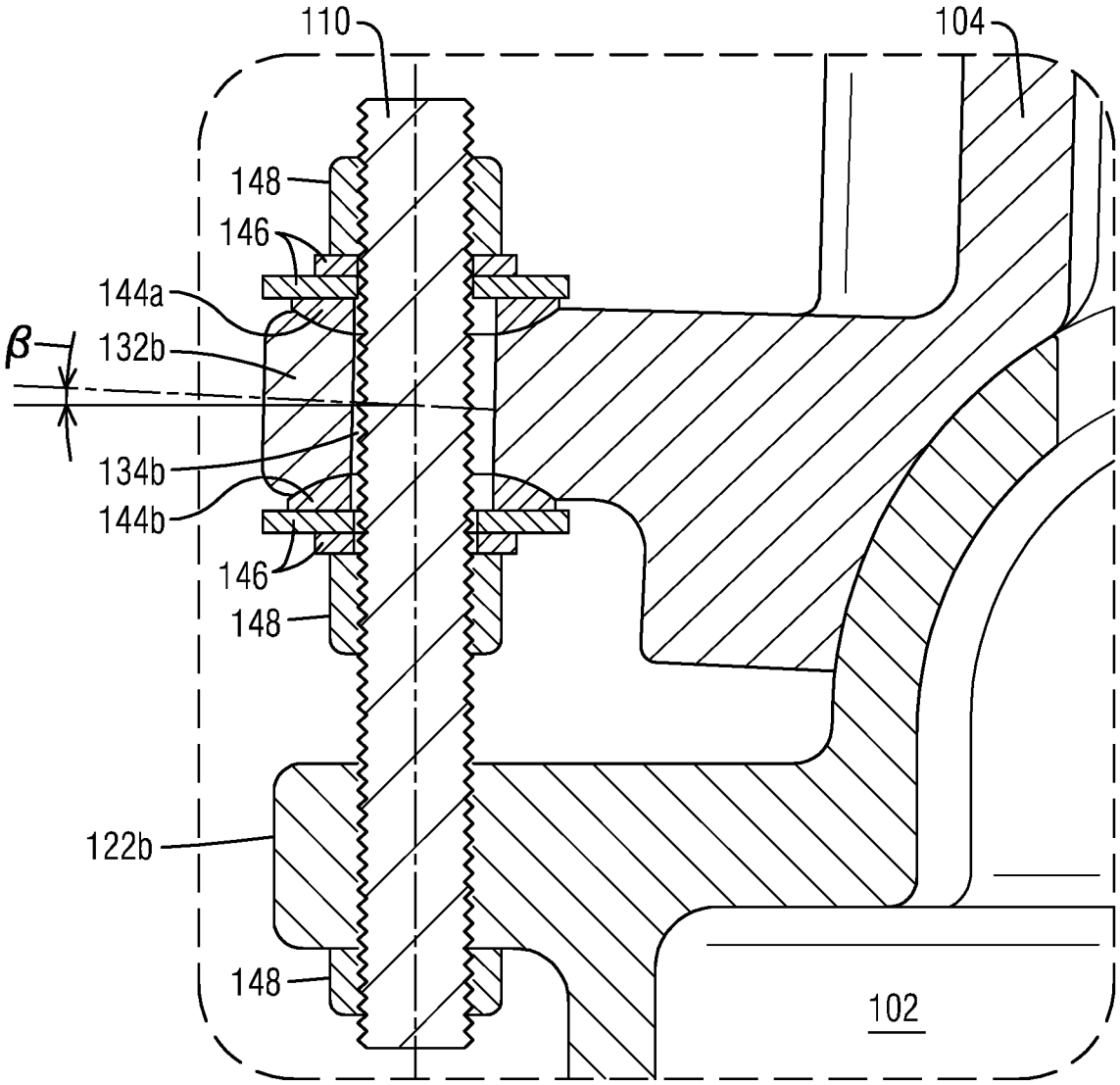
FIG. 9 illustrates an enlarged view of a section of the mounting arrangement of FIG. 8 in accordance with an exemplary embodiment of the present invention.

FIG. 9 illustrates an enlarged view of a section of FIG. 8 in accordance with an exemplary embodiment of the present invention. FIG. 9 illustrates that the connecting member 104 is tilted relative to the attachment member 102. This means that the extensions 122*b* and 132*b* are not parallel to each other, but arranged at an angle β to each other. Angle β may be between 0° and about +2.5° (or between 0° and about −2.5° when tilted in an opposite direction). FIG. 9 further illustrates the fastening elements 110 supported by the spherical washers 144, specifically upper spherical washer 144*a* and lower spherical washer 144*b*. Additional washers 146 and nuts 148 can be used, wherein different numbers and/or shapes of washers and/or nuts can be used when assembling the attachment member 102 and the connecting member 104.

A maximum tilting motion (forward or rearwards) of the connecting member 104 is limited by an inner diameter of the upper spherical washer 144*a*. According to an exemplary embodiment of the present invention, the inner diameter of the upper spherical washer 144*a* is increased in order to increase the maximum tilting motion of the connecting member 104. An increased inner diameter of the upper spherical washer 144*a* together with a larger through hole 134*b* in the extension 132*b* allow an increased maximum tilting motion. In a further exemplary embodiment of this invention, the inner diameter of the upper spherical washer 144*a* can be chosen such that it provides a tilt limiting function. This means that the inner diameter will come in contact with the adjusting stud 10 when the connecting member 104 reaches a maximum (tilting) angle β thereby preventing further tilting. FIG. 9 illustrates that the left side of the inner diameter of the washer 144*a* is in contact with the adjusting stud 10. When the connecting member 104 is tilted in an opposite direction, the right side of the inner diameter of the washer 144*a* would be in contact with the adjusting stud 10 and prevent further tilting of the connecting member 104. A degree of the tilting angle β is in correlation to an offset of the washer 144*a* to the stud 10. In other words, the greater the tilting angle β, the greater the offset of the upper washer 144*a* to the stud 10. The lower spherical washer 144*b* may also be offset to the stud 10 (the offset of the lower washer 144*b* is less than the offset of the upper washer 144*a*) but does not provide the tilt limiting function as described for the upper spherical washer 144*a*.

Figure 10:
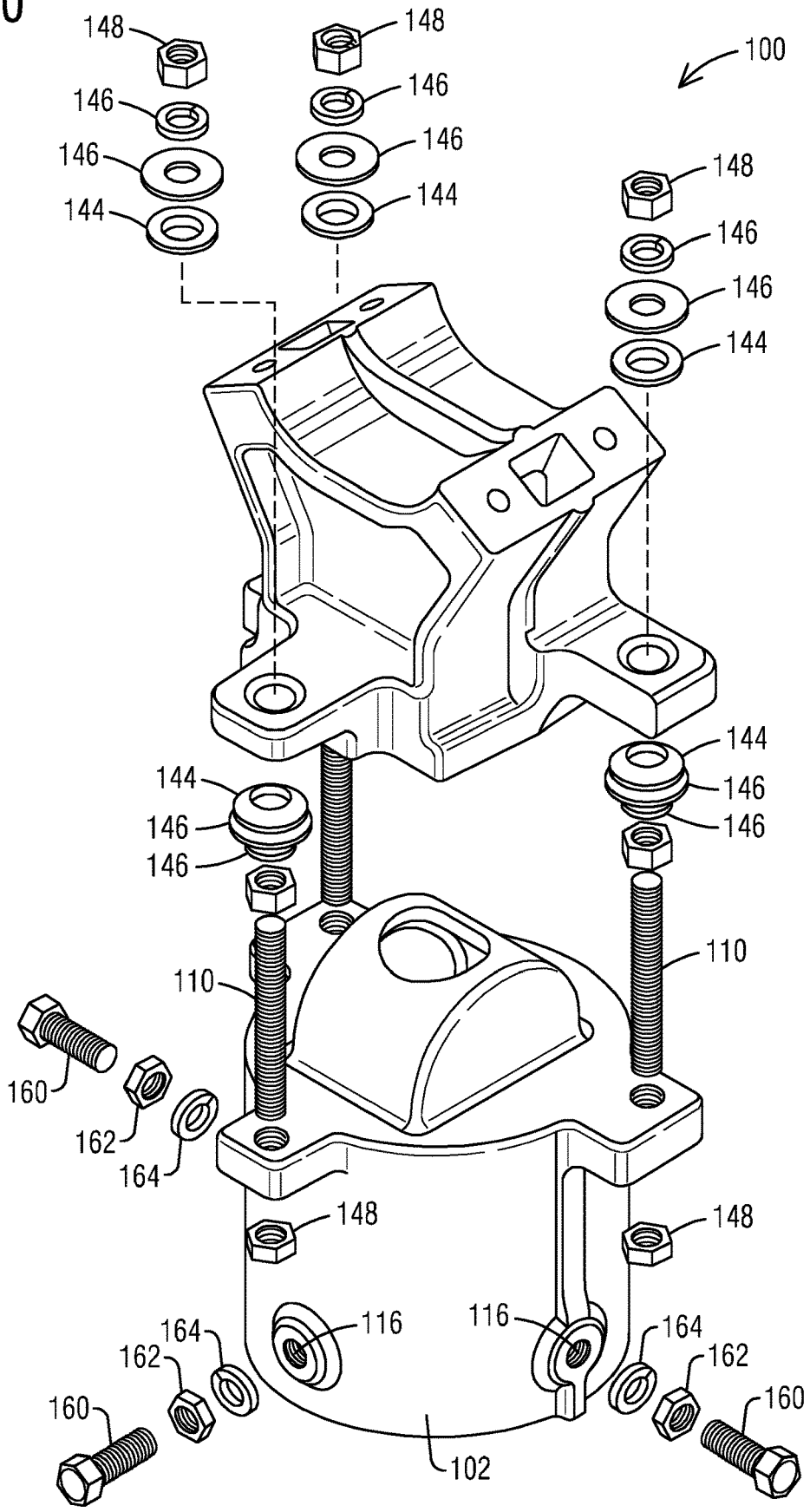
FIG. 10 illustrates an exploded view of the mounting arrangement as illustrated in FIG. 2 in accordance with an exemplary embodiment of the present invention.

FIG. 10 illustrates an exploded view of the mounting arrangement 100 as illustrated in FIG. 2 in accordance with an exemplary embodiment of the present invention.

As described before with reference to FIG. 2, the attachment member 102 can be fixed to an end of a cylindrical post, for example via the set screws or bolts 160 (see also FIG. 8). Thus, the attachment member 102 comprises the openings 116, for example threaded openings, for receiving the set screws 160. Nuts 162 and washers 164 can be used in combination with the set screws 160. It should be noted that the set screws 160 can also be used for a rotational adjustment, for example left to right aiming adjustment, of the mounting arrangement 100 when mounted to the post 114 (see FIG. 3) which also serves as rotational adjustment of a signal head coupled to the arrangement 100. The rotational adjustment of the arrangement 100 includes loosening the bolts 160, rotating the arrangement 100, and retightening the bolts 160.

FIG. 10 further illustrates the fastening elements 110, embodied for example as adjusting studs, used for connecting the attachment member 102 and the connecting member 104. The fastening elements 110 are supported by spherical washers 144, wherein each fastening element 110 are assigned two spherical washers 144. Additional washers 146 and nuts 148 can be used, wherein different numbers and/or shapes of washers and/or nuts can be used when assembling the mounting arrangement 100.

In a further exemplary embodiment, the attachment member 102 and connecting member 104 comprise metal and/or metal alloy. For example, the attachment member 102 and connecting member 104 comprise aluminum, in particular consist entirely of aluminum. Specifically, the attachment member 102 and connecting member 104 are aluminum alloy castings. In a further embodiment, the attachment member 102 and connecting member 104 comprise aluminum alloy which has T6 heat treatment to increase strength, hardness and other mechanical properties. As noted before, one of ordinary skill in the art is familiar with T6 heat treatment. For example, the attachment member 102 and connecting member 104 comprise aluminum casting alloy A356 T6.

Summarizing, the mounting arrangement 100 is designed such that a secure and strong connection of the attachment member 102 and the connecting member 104 is provided. Specifically, the fastening elements 110, configured as adjusting studs, contribute to the strong and secure connection and function as structural supports in all wind loaded directions when the mounting arrangement 100 together with a signal head is installed along a railway track. The mounting arrangement 100 withstands high winds with wind speeds of 90 mph or more when installed.

Additionally, an adjustable tilting feature is provided by the two mating cylindrical surfaces 118 and 140 of the two members 102 and 104. Also, the two mating cylindrical surfaces 118 and 140 transfer dead load of a signal assembly (including a signal head) to the post 114 and post supporting structure directly. Thus, the internal cylindrical surfaces 118 and 140 allow for an improved load bearing connection while the fastening elements 110, specifically three adjustment studs, securely hold the two members 102 and 104 together and allow for fine up and down aiming/tilting of the arrangement 100. Spherical washers 144 are used in combination with the fastening elements 110 so that the strong and secure connection is guaranteed even when the connecting member 104 is tilted relative to the attachment member 102, wherein the spherical washers 144 further provide a tilt limiting feature. The mating surfaces 118 and 140 allow at least a ±2.5° tilting motion, i.e. a total tilting motion of at least 5°, to align a signal head carried by the connecting member 104. A rotational (left to right) aiming adjustment point is shifted to the post attaching set screws 160 (or alternatively to a mast to junction box connection). Furthermore, the presented mounting arrangement 100 is faster to assemble and easier to service in the field as the signal attaching hardware is now completely accessible in the signal head housing.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. A mounting arrangement comprising:

an attachment member for attachment to an end of a post, a connecting member coupled to the attachment member, and a plurality of fastening elements coupling the connecting member to the attachment member, each fastening element comprising a longitudinal axis, longitudinal axes of the plurality of fastening elements being substantially parallel to each other, wherein the connecting member is coupled to the attachment member in a direction defined by the longitudinal axes of the plurality of fastening elements, wherein the attachment member and the connecting member comprise mating cylindrical surfaces which allow a tilting motion of the connecting member about a rotating axis which is perpendicular to the longitudinal axes of the plurality of fastening elements, and further comprising spherical washers used in combination with the fastening elements for coupling the connecting member to the attachment member, wherein for each fastening element an upper spherical washer and a lower spherical washer are provided, wherein the upper spherical washer comprises an increased inner diameter to allow an increased maximum tilting motion of the connecting member, and wherein a section of the increased inner diameter of the upper spherical washer is in contact with the fastening element when the connecting member reaches a maximum tilting angle preventing further tilting of the connecting member.

2. The mounting arrangement as claimed in claim 1, wherein the connecting member is rotatable about the rotating axis over an angle of at least about 5°.

3. The mounting arrangement as claimed in claim 1, wherein the attachment member comprises a cylindrical base body including a plurality of threaded openings for fastening the attachment member to the post via a plurality of bolts, the plurality of bolts allowing a rotational adjustment of the attachment member.

4. The mounting arrangement as claimed in claim 3, wherein the attachment member comprises a convex cylindrical surface arranged on an upper end of the base body curved toward the connecting member.

5. The mounting arrangement as claimed in claim 3, wherein the attachment member comprises a plurality of extensions on an upper end of the base body extending outwards from the base body, each extension comprising a circular opening which each receive a fastening element of the plurality of fastening elements.

6. The mounting arrangement as claimed in claim 1, wherein the connecting member comprises a concave cylindrical surface arranged on a lower end of the connecting member and curved toward an inside of the connecting member.

7. The mounting arrangement as claimed in claim 1, wherein the connecting member comprises a plurality of extensions in a lower portion of the connecting member extending outwards from the connecting member, each extension comprising a circular opening which each receive a fastening element of the plurality of fastening elements.

8. The mounting arrangement as claimed in claim 7, wherein the openings of the connecting member face the extensions of the attachment member, the plurality of fastening elements extending through the openings.

9. The mounting arrangement as claimed in claim 7, wherein the circular openings each comprise concave spherical radiuses at axial ends of the openings.

10. The mounting arrangement as claimed in claim 1, wherein the spherical washers are placed such that the spherical washers abut upon the concave spherical radiuses of the openings.

11. The mounting arrangement as claimed in claim 1, wherein the plurality of fastening elements are configured as studs.

12. The mounting arrangement as claimed in claim 1, wherein each of the plurality of fastening elements comprises metal alloy.

13. The mounting arrangement as claimed in claim 1, wherein the attachment member and the connecting member comprise metal alloy castings.

14. A railway wayside signal assembly comprising:

a post or mast for installing along a railway track, a mounting arrangement carried by the post or mast, the mounting arrangement comprising:

an attachment member for attachment to an end of the post or mast, a connecting member coupled to the attachment member, and a plurality of fastening elements coupling the connecting member to the attachment member, each fastening element comprising a longitudinal axis, longitudinal axes of the plurality of fastening elements being substantially parallel to each other, wherein the connecting member is coupled to the attachment member in a direction defined by the longitudinal axes of the plurality of fastening elements, and wherein the attachment member and the connecting member comprise mating cylindrical surfaces which allow a tilting motion of the connecting member about a rotating axis which is perpendicular to the longitudinal axes of the plurality of fastening elements, and further comprising spherical washers used in combination with the fastening elements for coupling the connecting member to the attachment member, wherein for each fastening element an upper spherical washer and a lower spherical washer are provided, wherein the upper spherical washer comprises an increased inner diameter to allow an increased maximum tilting motion of the connecting member, and wherein a section of the increased inner diameter of the upper spherical washer is in contact with the fastening element when the connecting member reaches a maximum tilting angle preventing further tilting of the connecting member.

15. The railway wayside signal assembly as claimed in claim 14, wherein the connecting member is adapted to carry a signal unit.

16. The railway wayside signal assembly as claimed in claim 15, wherein the connecting member comprises a plurality of tapped mounting holes for mounting the signal unit to the connecting member by bolts such that heads of the bolts are accessible from the signal unit.

17. The railway wayside signal assembly as claimed in claim 14, wherein the mating cylindrical surfaces transfer dead load of a railway signal unit to the post or mast.

18. The railway wayside signal assembly as claimed in claim 14, wherein the post or mast comprises a cylindrical cross section.

* * * * *